US007637564B1

(12) United States Patent
Schroeder et al.

(10) Patent No.: US 7,637,564 B1
(45) Date of Patent: Dec. 29, 2009

(54) VACUUM SYSTEM FOR A HIGHCHAIR

(76) Inventors: Zachary D. Schroeder, 3374 Raleigh Way Ct., Mobile, AL (US) 36695; Candiace A. Schroeder, 3374 Raleigh Way Ct., Mobile, AL (US) 36695

( * ) Notice: Subject to any disclaimer, the term of this patent is extended or adjusted under 35 U.S.C. 154(b) by 119 days.

(21) Appl. No.: 11/973,469

(22) Filed: Oct. 9, 2007

(51) Int. Cl.
*A47D 15/00* (2006.01)
*A47C 7/62* (2006.01)

(52) U.S. Cl. ..... 297/182; 297/217.1; 297/217.3

(58) Field of Classification Search ..... 297/216.1, 297/217.1, 217.3, 182; 15/304
See application file for complete search history.

(56) References Cited

U.S. PATENT DOCUMENTS 2,344,149 A 3/1944 Jory
2,590,673 A 3/1952 Bezanson
3,409,326 A * 11/1968 Kerner ..... 280/753
3,663,432 A * 5/1972 Ellison ..... 180/89.11
3,729,037 A 4/1973 Dare et al.
3,770,318 A * 11/1973 Fenton ..... 297/452.47
3,895,841 A * 7/1975 Lebert ..... 297/464
3,994,042 A * 11/1976 Zakis ..... 15/312.1
4,332,560 A * 6/1982 Rait ..... 433/92
4,594,747 A * 6/1986 Dempsey ..... 15/301
4,601,065 A 7/1986 Sigl et al.
4,606,576 A 8/1986 Jones
4,848,834 A 7/1989 Linski
5,496,090 A * 3/1996 Emmett et al. ..... 297/240
5,649,997 A * 7/1997 Cavallero et al. ..... 95/284
5,758,387 A * 6/1998 McNamara ..... 15/301
5,927,817 A * 7/1999 Ekman et al. ..... 297/452.47
6,481,047 B1 * 11/2002 Schaefer ..... 15/314
6,588,821 B2 7/2003 Worrell et al.
6,851,748 B1 * 2/2005 Garrick ..... 297/240
6,928,235 B2 8/2005 Pollack

* cited by examiner

*Primary Examiner*—Sarah B McPartlin
(74) *Attorney, Agent, or Firm*—George L. Williamson

(57) ABSTRACT

A vacuum system for highchairs wherein a wet/dry vacuum is attached to the back of the highchair having conduits running from the vacuum to the bottom of the seat of the highchair and into the sides of the tray of the highchair so that food spillage can be removed from the seat and tray of the highchair by having the food spillage be removed into the vacuum through conduits running from the vacuum to the certain areas of the highchair as previously specified. The tubing could be plastic material or the like that could be removed for cleaning.

8 Claims, 3 Drawing Sheets

VACUUM SYSTEM FOR A HIGHCHAIR

BACKGROUND OF THE INVENTION

1. Field of the Invention

The present invention relates to highchairs and, more particularly is concerned with a vacuum system for removing food waste particles and liquids from a highchair.

2. Description of the Prior Art

Methods for cleaning devices have been described in the prior art, however, none of the prior art devices disclose the unique features of the present invention.

U.S. Pat. No. 4,606,576, dated Aug. 19, 1986 to Jones, disclosed a tray for a highchair for collecting spilled food upon its surface.

U.S. Pat. No. 6,528,235, dated Aug. 9, 2005 to Pollack, disclosed a forced air dryer for infants bottoms related to diaper changing tables.

U.S. Pat. No. 6,588,821, dated Jul. 8, 2003, to Worrell, et al., disclosed a folding multi-purpose console related to babies care.

U.S. Pat. No. 4,848,834, dated Jul. 18, 1989, to Linski disclosed an infant food catch.

U.S. Pat. No. 4,601,065, dated Jul. 22, 1986, to Sigl, et al., disclosed a bib with a cloth catcher.

U.S. Pat. No. 2,344,149, dated Mar. 14, 1944, to Jory, disclosed a device for cleaning tables.

U.S. Pat. No. 3,729,037, dated Apr. 24, 1973, to Dare, et al., disclosed a disposable highchair tray cover.

U.S. Pat. No. 2,590,673, dated Mar. 25, 1952, to Bezanson, disclosed a vacuum cleaner for barber chairs.

While these methods for cleaning may be suitable for the purposes for which they were designed, they would not be as suitable for the purposes of the present invention, as hereinafter described.

SUMMARY OF THE PRESENT INVENTION

The present invention discloses a vacuum system for highchairs wherein a wet/dry vacuum is attached to the back of the highchair having conduits running from the vacuum to the bottom of the seat of the highchair and into the sides of the tray of the highchair so that food wastes can be removed from the seat and tray of the highchair by having the food wastes be removed into the vacuum through conduits running from the vacuum to the certain areas of the highchair as previously specified. The vacuum is expected to be a wet/dry vacuum and be mounted on the back of the highchair. The tubing would be plastic material or the like that can be removed for cleaning.

An object of the present invention is to provide a vacuum system for a highchair so that the highchair can be more easily cleaned. Another object of the present invention is to provide a system for removing food particles from the seat and tray of the highchair. A further object of the present invention is to provide a system for removing food particles from a highchair which system can be easily and relatively inexpensively manufactured.

The foregoing and other objects and advantages will appear from the description to follow. In the description, reference is made to the accompanying drawings, which form part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
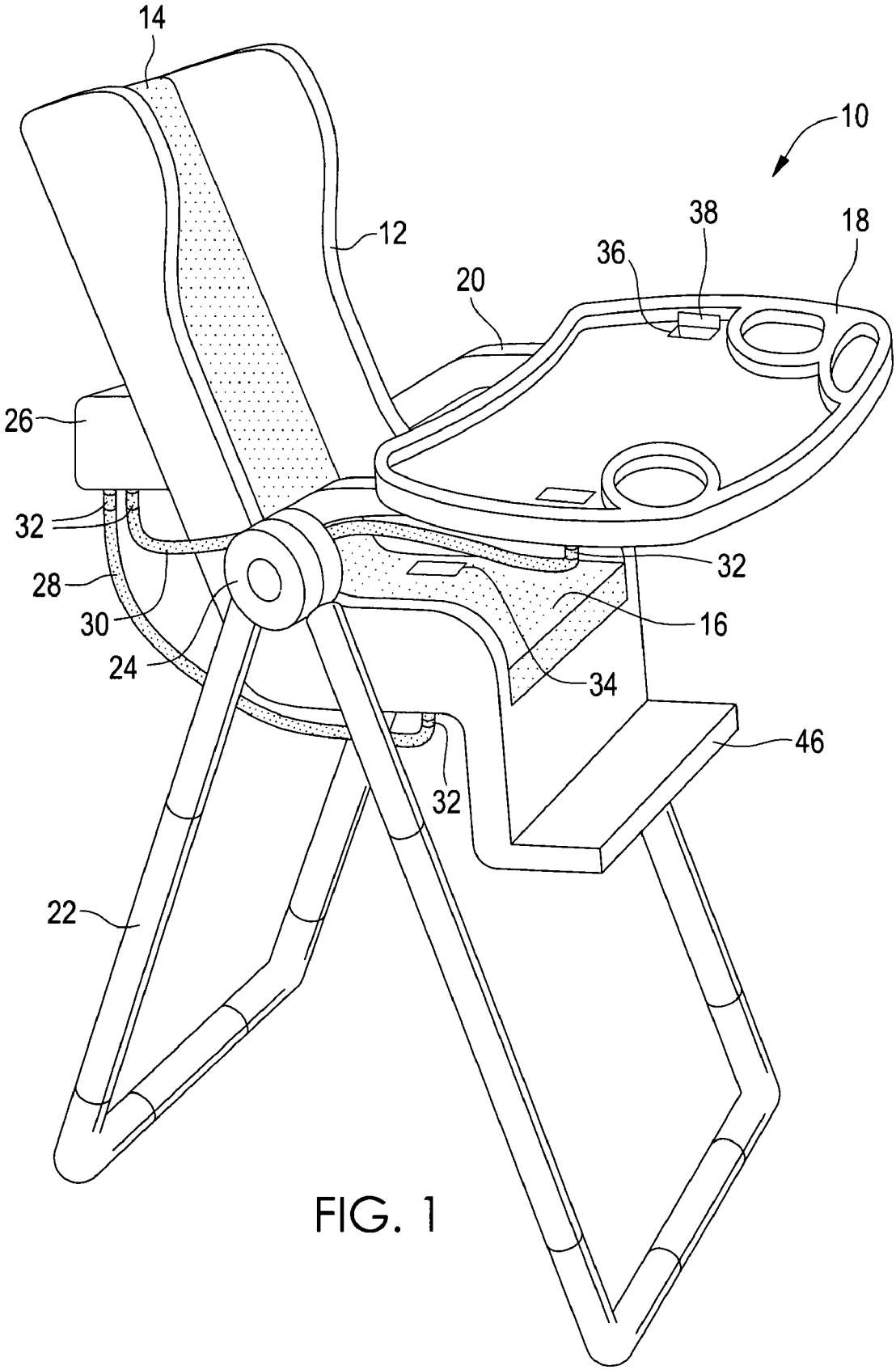
FIG. 1 is a perspective view of one embodiment of the present invention.

With regard to reference numerals used, the following numbering is used throughout the drawings.

10 present invention
12 highchair
14 back
16 seat
18 tray
20 arms
22 legs
24 connection
26 vacuum unit
28 hose
30 hose
32 coupling
34 inlet
36 inlet
38 cover
40 conduit
42 conduit
44 conduit
46 foot rest
48 power supply
50 switch
52 receptacle

DETAILED DESCRIPTION OF THE PREFERRED EMBODIMENT

The following discussion describes in detail the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a vacuum system for cleaning a highchair is disclosed.

Figure 2:
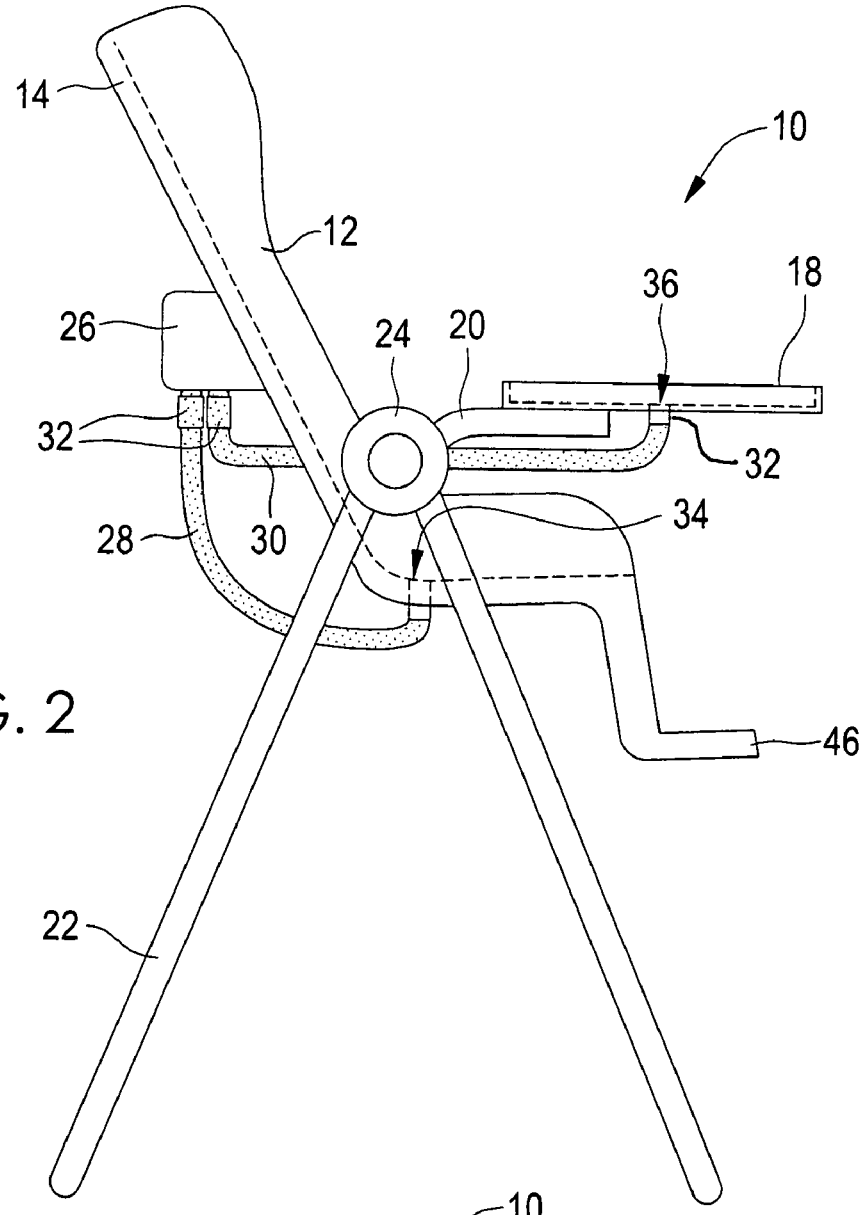
FIG. 2 is an elevation view of one embodiment of the present invention.
Figure 3:
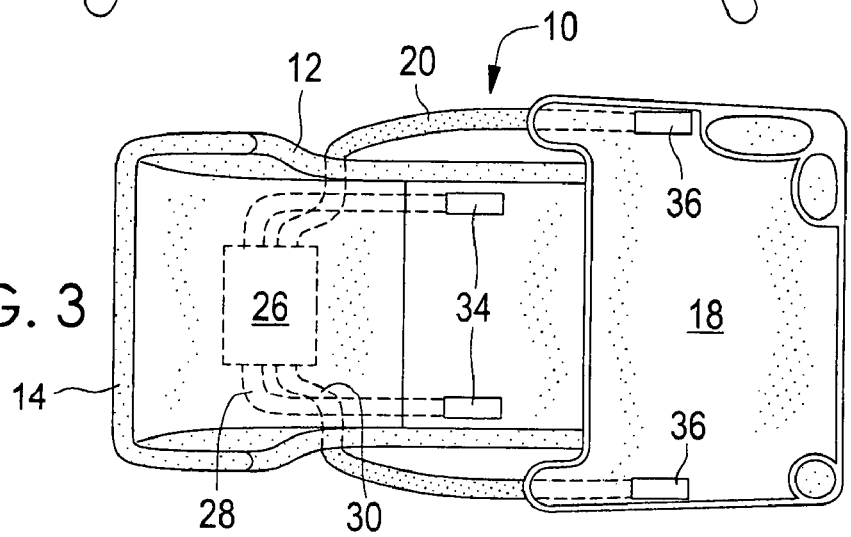
FIG. 3 is a plan view of one embodiment of the present invention.

Turning to FIGS. 1-3, therein is shown the present invention 10 comprising a highchair 12 having a back 14 thereon, the back having front and rear sides and left and right sides, a seat 16 having upper and lower surfaces and left and right sides, along with a food tray 18 mounted on the front of the highchair, the tray having an upper and lower surface, and a left and right side. Also shown are arms 20 being a left arm and a right arm along with multiple legs 22 having corresponding left and right portions along with a means of connecting and adjusting 24 the legs to the left and right portions of the highchair near the rear of the arms 20 on the highchair 12. Also shown is a vacuum unit 26 disposed on the rear surface of the seat back 14 having hoses 28 and 30 going to the bottom of the seat 16 and tray 18, respectively, having couplers 32 for removably connecting the ends of the hoses to their termination points. Also shown is a seat inlet 34 being somewhat rectangularly shaped and enlarged so that it can received food spillage particles therein and inlet 36 disposed on tray 18 being similarly shaped and having a cover or lid 38 disposed thereon so as to prevent food particles from entering the inlets at undesirable times. It is expected that the vacuum unit 26 will be electrically operated having an electric motor along with a receptacle or storage unit to contain vacuum food particles which have been removed from the seat 16 and tray 18 of the highchair 12. A footrest 46 is also shown. Tray 18 is supported by arms 20. A removable storage receptacle 52 for collection of spillage is also disclosed.

Figure 4:
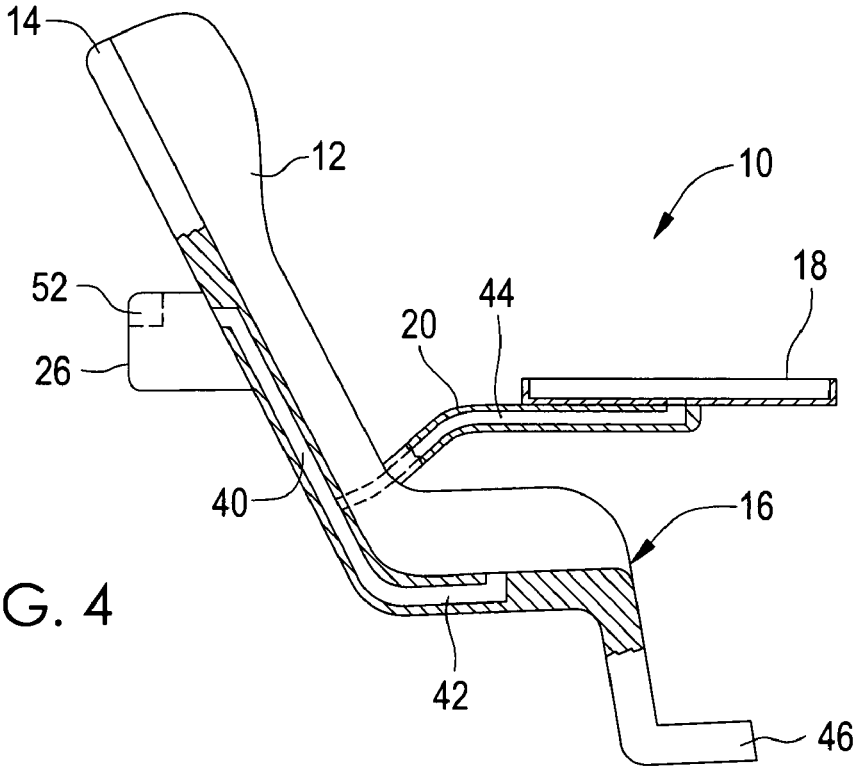
FIG. 4 is a section view of one embodiment of the present invention.

Turning to FIG. 4, therein is shown the present invention 10 with the highchair 12 with back 14, seat 16, arms 20 and footrest 46 wherein the vacuum unit 26 disposed on the rear surface of the back having conduits 40 integrally manufactured into the back and arms of the chair with conduits 42 leading into the seat of the highchair along with conduits 44 in the arms 20 of the highchair terminating at the tray 18 and the seat 16. The main feature of this embodiment is that it comprises intergrately disposed conduits 40, 42 and 44 for connecting vacuum 26 with seat 16 and tray 18.

Figure 5:
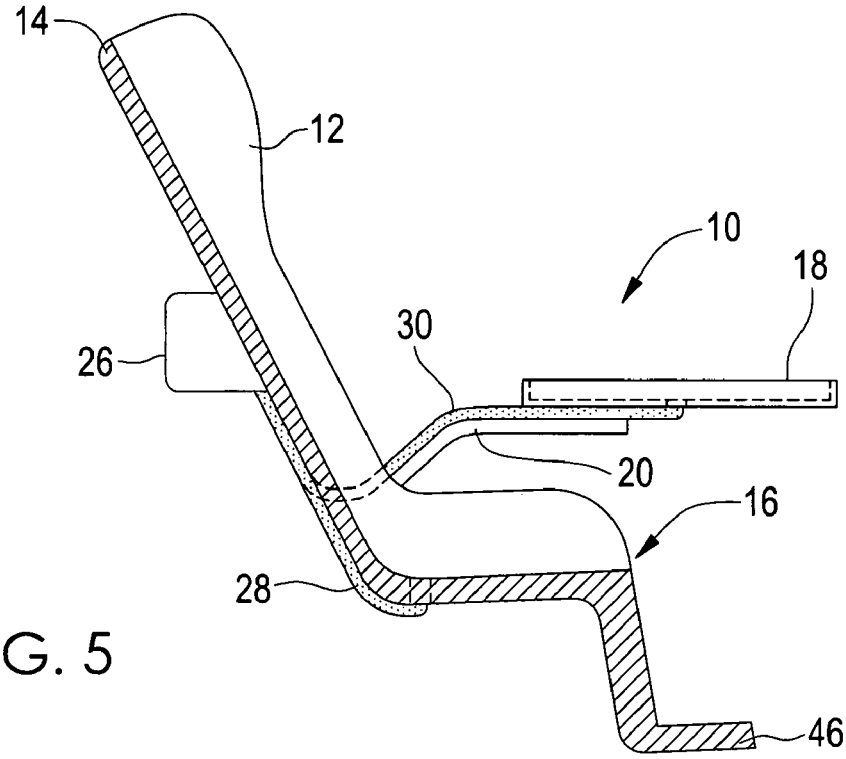
FIG. 5 is a section view of one embodiment of the present invention.

Turning to FIG. 5, therein is shown the present invention 10 with the highchair 12 with back 14, and seat 16, arms 20 and footrest 46, wherein the vacuum unit 26 disposed on the rear surface of the back having conduits 28, 30 disposed so as to be contiguous with the back and arms of the chair with conduit 28 leading into the seat of the highchair along with conduits 30 leading along the arms 20 of the highchair terminating at the tray 18 and the seat 16. The main feature of this embodiment is that conduits 28, 30 are disposed contiguous to corresponding parts of chair 12.

Figure 6:
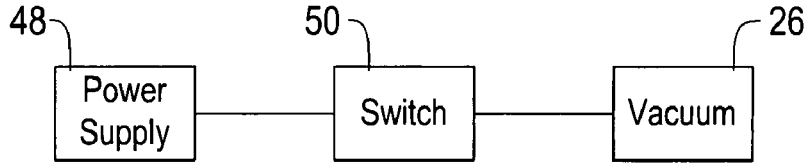
FIG. 6 is a schematic diagram of portions of the present invention.

Turning to FIG. 6, therein is shown the power supply 48 and switch 50 for the vacuum unit 26. The vacuum unit is expected to have a removable storage receptacle for spillage collection.

We claim:

1. An apparatus for cleaning a seat and tray of a highchair, comprising:

a) a highchair for seating a child, said highchair having a back, a seat, first and second arms, and a tray, said back having a back surface, said seat having a top and bottom side, said tray having a top and bottom side and a raised portion forming a low wall disposed around the periphery of said tray for collecting solid and liquid food spillage, wherein said highchair is supported by at least one leg;

b) a vacuum unit being disposed on said highchair, said vacuum unit having an inlet;

c) a first inlet being disposed on said tray, wherein said first inlet is sized for solid and or liquid food spillage to enter said first inlet;

d) a second inlet disposed on said seat, wherein said second inlet is sized for solid and liquid food spillage to enter said second inlet;

e) a first conduit connecting said first inlet to said inlet of said vacuum unit, wherein said first conduit is sized for solid and liquid food spillage to be carried from said tray to said vacuum unit;

f) a second conduit connecting said second inlet to said inlet of said vacuum unit, wherein said second conduit is sized for solid and liquid food spillage to be carried from said seat to said vacuum unit; and, g) a storage receptacle for collection of solid and liquid food spillage.

2. The apparatus of claim 1, wherein said first and second conduits are integrally disposed in said highchair.

3. The apparatus of claim 1, further comprising a plurality of first inlets disposed on said tray, wherein said plurality of first inlets are connected to said inlet of said vacuum unit by a plurality of conduits.

4. The apparatus of claim 1, further comprising a plurality of second inlets disposed on said seat, wherein said plurality of second inlets are connected to said inlet of said vacuum unit by a plurality of conduits.

5. The apparatus of claim 1, wherein said first and second conduits are removably connected to said first and second inlets and to said inlet of said vacuum unit to permit the conduits to be removed and cleaned.

6. The apparatus of claim 5, wherein said first and second conduits comprise plastic material.

7. The apparatus of claim 6, a cover being disposed on each said inlet of said first and second conduit.

8. A method for cleaning a seat and tray of a highchair, comprising:

a) providing a highchair for seating a child, the highchair having a back, a seat, first and second arms, and a tray, the hack having a hack surface, the seat having a top and bottom side, the tray having a top and bottom side and a raised portion forming a low wall disposed around the periphery of the tray for collecting solid and liquid food spillage, wherein the highchair is supported by at least one leg;

b) providing a vacuum unit on the highchair, the vacuum unit having an inlet;

c) providing a first inlet on the tray, wherein the first inlet is sized for solid and or liquid food spillage to enter the first inlet;

d) providing a second inlet disposed on the seat, wherein the second inlet is sized for solid and liquid food spillage to enter the second inlet;

e) providing a first conduit connecting the first inlet to the inlet of the vacuum unit, wherein the first conduit is sized for solid and liquid food spillage to be carried from the tray to the vacuum unit;

f) providing a second conduit connecting the second inlet to the inlet of the vacuum unit, wherein the second conduit is sized for solid and liquid food spillage to be carried from the seat to the vacuum unit; and, g) providing a storage receptacle for collection of solid and liquid food spillage.

* * * * *